United States Patent [19]

Cipollone

[11] 4,127,153

[45] * Nov. 28, 1978

[54] DOVETAIL MACHINE AND SLIDING DOVETAIL CONSTRUCTION

[76] Inventor: Albert Cipollone, 173 A Pleasant St., Melrose, Mass. 02176

[ * ] Notice: The portion of the term of this patent subsequent to Jun. 28, 1993, has been disclaimed.

[21] Appl. No.: 275,817

[22] Filed: Jul. 27, 1972

[51] Int. Cl.[2] ..... B27C 9/04

[52] U.S. Cl. ..... 144/3 R; 83/571; 83/613; 144/85; 144/134 A; 144/136 R; 144/309 L; 144/326 R

[58] Field of Search ..... 144/3 R, 85-90, 144/134 R, 134 A, 134 B, 136 R, 309 L, 309 R, 321, 323, 326 R, 1 R, 2 R; 83/613, 614, 616, 571

[56] References Cited

U.S. PATENT DOCUMENTS

| | | | |
|---|---|---|---|
| 1,456,864 | 5/1923 | Brood et al. | 144/90 R |
| 1,736,924 | 11/1929 | Lagus | 144/134 R X |
| 1,839,599 | 1/1932 | Schimmel | 144/136 R X |
| 2,036,348 | 4/1936 | Miller | 144/87 |
| 2,930,415 | 3/1960 | Cravens | 144/134 B X |
| 3,078,888 | 2/1963 | Bruemmer | 144/3 R X |
| 3,339,601 | 9/1967 | Christman et al. | 144/3 R X |
| 3,470,924 | 10/1969 | Short | 144/136 R |
| 3,547,171 | 12/1970 | Jacumin | 144/85 X |
| 3,547,171 | 12/1970 | Jacumim | 144/136 R |
| 3,770,031 | 11/1973 | Olson | 144/136 R |
| 4,005,738 | 2/1977 | Strange et al. | 144/133 R |

*Primary Examiner*—Othell M. Simpson
*Assistant Examiner*—W. D. Bray
*Attorney, Agent, or Firm*—Cesari and McKenna

[57] ABSTRACT

A machine in one bench assembly cuts male and female dovetails to measure. A sliding dovetail construction provides interlocking without fastenings.

1 Claim, 1 Drawing Figure

DOVETAIL MACHINE AND SLIDING DOVETAIL CONSTRUCTION

This invention relates generally to cabinet furniture, more particularly to furniture construction utilizing dovetail joints.

A principal object of the present invention is to provide a machine on which panels may be positioned to measure and dovetailed.

Another object of this invention is to teach an interlocking dovetail construction for cabinets that eliminates all fastenings.

These and other objects will be readily evident upon a study of the following specification together with the accompanying drawings wherein.

Figure 1:
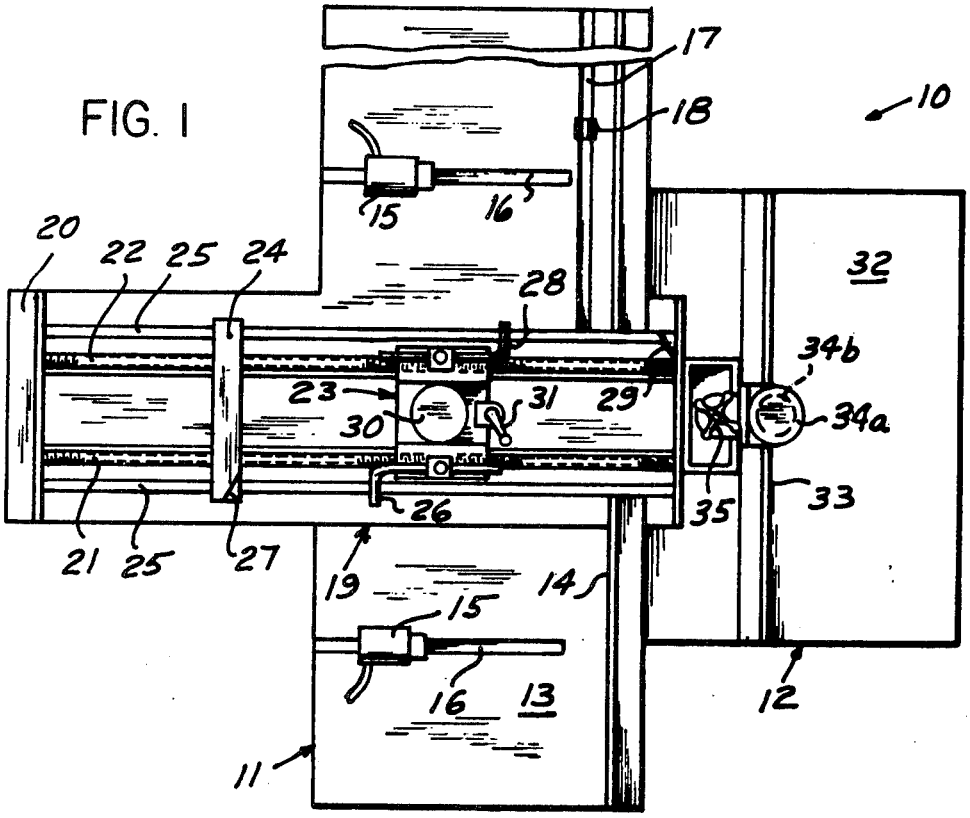
FIG. 1 is a plan view of a dovetailing machine.

REFERRING TO FIG. 1, a machine 10 comprises a female dovetail cutting assembly 11 and a male dovetail cutting assembly 12.

Assembly 11 shows a bed surface 13 provided with a fence 14 and a pair of pneumatic clamps 15. Clamps 15 are adjustable and securable in a pair of channels 16. Another channel 17 is provided for securing one or more spring stops 18.

A cutter drive 19 positioned above assembly 11 comprises a motorized gear drive 20, a pair of oppositely threaded drive rods 21 and 22, a cutter carriage 23 and a carriage stop 24 slideable on a pair of rails 25. Carriage 23, slideable on rods 21 and 22, is provided with split nut levers 26 and 28. Besides being manually operable, levers 26 and 28 are automatically operated in their travel limit positions. Lever 26 upon arriving at carriage stop 24, strikes a cam 27. Similarly, lever 28, upon arriving at the opposing limit of travel, strikes a cam 29. When the split nut operated by lever 26 engages rod 21, carriage 23 moves forward. When the split nut operated by lever 28 engages rod 22, carriage 23 moves in reverse. It then becomes evident that carriage 23 may be manually locked or released on either drive rod 21 or 22 and in any position, and that cams 27 and 29 operate to stop and reverse the carriage.

It is now evident that the split nut levers together with the cams serve to arrest the travel of the carriage automatically. Thus when the carriage travels toward the left, the split nut lever 26 engages the cam 27 so to cause the lever to turn and unlock; and in a similar manner when the carriage travels toward the right as shown in FIG. 1, the split nut lever 28 engages the cam 29 so to cause the lever to be turned.

Carriage 23 supports a motorized female dovetail cutter head 30 vertically adjustable by a crank 31.

In use, a panel is placed on bed 13 against fence 14 and stop 18. Clamps 15, which may be locked in channel 16 for a production run, are energized to secure the panel against fence 14. Carriage 23 is then positioned at the panel edge and stop 24 is positioned behind the carriage. Depressing lever 26 starts the cutting cycle which ends with the carriage stopping after returning to the start position and is then readiness for the next panel.

Referring to assembly 12, there is provided a bed 32, a fence 33 and a pair of axially aligned male cutter heads. For ease of illustration, the lower male cutter head **34*b* is shown in phantom in FIG. 1 and of a smaller size than the upper male cutter head 34*a*, but typically both male cutter heads 34*a* and 34*b* would be of the same size. The upper male cutter head 34*a* is vertically adjustable above bed 32 by a knob 35. Operation of this part of machine 10** is self-evident from inspection of the figure and the known art of sliding a piece of work against a fence and pass a cutter head.

Figure 2:
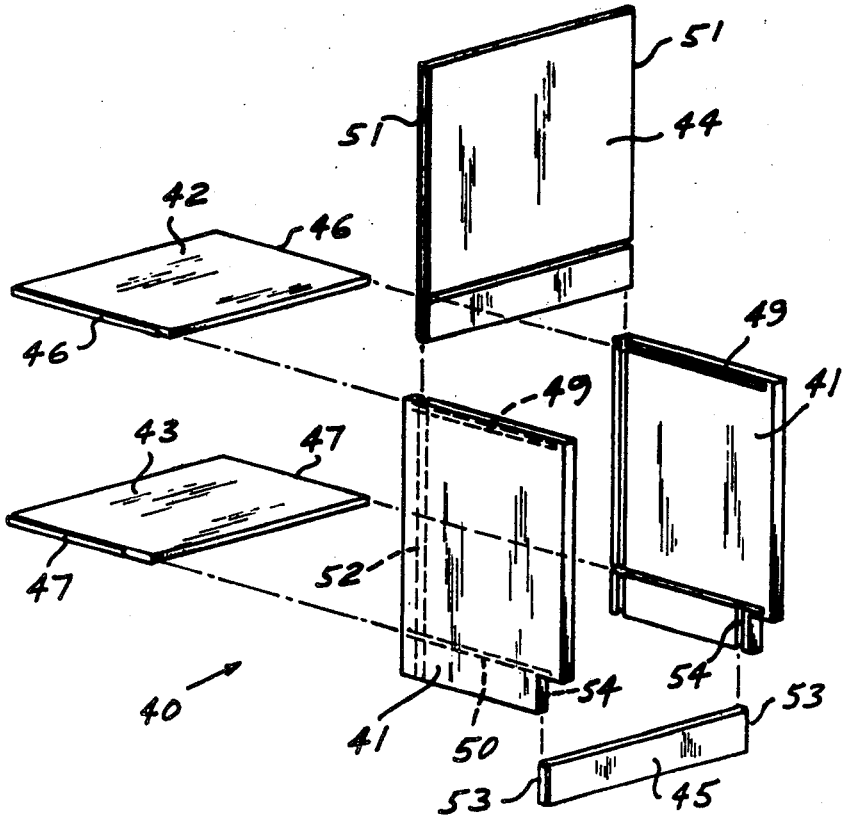
FIG. 2 is an exploded perspective view of an interlocking dovetail construction.

Referring to FIG. 2, a group of dovetail panels 40, prepared using the machine 10 of FIG. 1, shows a pair of side panels 41, an upper horizontal panel 42, a lower horizontal panel 43, a back panel 44 and a tow panel 45.

Panels 42 and 43 having dovetails 46 and 47 are slid into dovetails 49 and 50 in panels 41, panel 44 having dovetails 51 is then slid into dovetails 52 in panels 41. Finally panel 45 having dovetails 53 is slid into dovetails 54. It becomes obvious that this assembly is self-locking without the addition of any fasteners.

This novel dovetail construction is suited to general cabinet work, such as residential and institutional furniture, store fixtures, kitchen cabinets, etc. This method will form an interlocking construction in such a way as to become as strong as the material used, impossible to pull apart and without the use of nails, screws, bolts or facia fastenings of any type. With today's variety of materials available, this construction will be far more superior and much more economical to produce than present methods now used. Manufacturers costs will be cut from 25 to 75 percent, permitting the use of prelaminated and pre-edged materials with no concern of camouflaged fastenings.

What I claim is:

1. A female dovetail cutting machine, comprising a bed with means for holding a panel to be cut and a cutter head carriage movable on a pair of oppositely threaded rods driven in unison by a motorized gear box, a female dovetail cutter head carried by said carriage and adapted for cutting a female dovetail in the panel, said carriage being engageable with said rods for movement in either opposite direction therealong by manually operated split nut levers, a pair of rails disposed on said bed parallel to said rods, carriage stop means slidably supported on said pair of rails, said stop means including a cam engageable by one of said split nut levers so as to limit the travel of said carriage in at least one direction, said female dovetail cutting machine being in combination with a male dovetail cutting machine disposed adjacent a side edge of said bed, and comprising a separate bed, a fence against which a panel to be cut may be movably guided and a vertically adjustable pair of male dovetail cutter heads, said pair of male dovetail cutter heads being axially aligned and adjustable in respect to each other for cutting a male dovetail in the panel.

* * * * *